US010829723B2

(12) United States Patent
Reagan et al.

(10) Patent No.: US 10,829,723 B2
(45) Date of Patent: Nov. 10, 2020

(54) DEVICES FOR REMOVING OXIDIZABLE STAINS AND METHODS FOR THE SAME

(71) Applicant: Henkel IP & Holding GmbH, Duesseldorf (DE)

(72) Inventors: David Anthony Reagan, Ansonia, CT (US); Michael G. Crisanti, Woodbury, CT (US)

(73) Assignee: Henkel IP & Holding GmbH (DE)

( * ) Notice: Subject to any disclaimer, the term of this patent is extended or adjusted under 35 U.S.C. 154(b) by 0 days.

(21) Appl. No.: 16/022,970

(22) Filed: Jun. 29, 2018

(65) Prior Publication Data

US 2020/0002656 A1 Jan. 2, 2020

(51) Int. Cl.

| | |
|---|---|
| ***C11D 17/04*** | (2006.01) |
| ***B65D 81/32*** | (2006.01) |
| ***C11D 3/39*** | (2006.01) |
| ***D06L 4/10*** | (2017.01) |

(52) U.S. Cl.

CPC ..... *C11D 17/045* (2013.01); *B65D 81/3211* (2013.01); *C11D 3/3905* (2013.01); *C11D 17/044* (2013.01); *C11D 17/046* (2013.01); *D06L 4/10* (2017.01)

(58) Field of Classification Search

CPC . B65D 81/3211; C11D 17/046; C11D 17/045; C11D 17/044; D06L 4/10; B08B 3/08; B08B 3/04; A46B 11/0075; A46B 11/0041; A46B 2200/30; A46B 2200/3053

See application file for complete search history.

(56) References Cited

U.S. PATENT DOCUMENTS 3,786,820 A * 1/1974 Kopfer ..... A45D 29/04 132/74.5
5,098,297 A * 3/1992 Chari ..... A61M 35/006 401/132
5,160,654 A * 11/1992 Falou ..... C11D 17/044 510/277
5,490,736 A * 2/1996 Haber ..... A61M 35/006 401/132

(Continued)

OTHER PUBLICATIONS

Handbook of Detergents Part E: Applications [online]. Edited by Uri Zoller, University of Haifa-Oranim, Kiryat Tivon, Israel [retrieved on May 3, 2018]. Retrieved from Internet: <URL: https://books.google.com/books?id=mCgcrvvRlucC&pg=PA381&lpg=PA381&dq=DOBA+bleach+activator&source=bl&ots=yNezytrJln&sig=3V5R2aXf7830HnDVOjplURBL6Vw&hl=en&sa=X&ved=0ahUKEwje5J_YsOXaAhWkt1kKHayDAIAQ6AEINjAC#v=onepage&q=DOBA%20bleach%20activator&f=false>.

(Continued)

*Primary Examiner* — Patrick M. Buechner
(74) *Attorney, Agent, or Firm* — Bojuan Deng

(57) ABSTRACT

A device for removing oxidizable stains includes a device body having an opening and an internal space disposed therein. The device body includes a wall that at least partially surrounds the internal space. At least part of the wall is a flexible wall. A frangible wall separates the internal space into a first chamber and a second chamber. One or more solid components are disposed in the first chamber and include an active oxygen component. Water is disposed in the second chamber. A bleach activator component forms part of the one or more solid components or is included with water. The device is configured such that when a force is applied to strain the flexible wall, the frangible wall breaks to allow contact between water and the one or more solid components to form a peracid solution.

20 Claims, 1 Drawing Sheet

(56) References Cited

U.S. PATENT DOCUMENTS

| | | | | |
|---|---|---|---|---|
| 6,039,488 | A * | 3/2000 | Krawczyk | A01M 31/008 401/132 |
| 7,201,577 | B2 | 4/2007 | Levine | |
| 7,225,920 | B2 * | 6/2007 | Hoeffkes | A61K 8/02 206/222 |
| 7,597,497 | B2 | 10/2009 | Levine | |
| 8,372,937 | B2 * | 2/2013 | Trabesinger | B65D 81/3222 401/132 |
| 8,631,941 | B2 * | 1/2014 | Fazzolari | A45D 34/04 206/528 |
| 10,220,194 | B2 * | 3/2019 | Battaglia | A61M 35/006 |
| 2002/0018689 | A1 * | 2/2002 | Badejo | A61L 24/0021 401/132 |
| 2005/0111900 | A1 * | 5/2005 | Fazzolari | A45D 34/02 401/132 |
| 2008/0093387 | A1 * | 4/2008 | Pivonka | A45D 34/04 222/205 |
| 2015/0265511 | A1 * | 9/2015 | Boyd | A61K 8/38 424/50 |
| 2018/0100122 | A1 | 4/2018 | Gaudreault | |
| 2018/0361175 | A1 * | 12/2018 | Xu | A61Q 11/02 |
| 2018/0362892 | A1 * | 12/2018 | Beckholt | C11D 3/3945 |

OTHER PUBLICATIONS

Bleach Activator [online]. (n.d.). In Wikipedia Retrieved May 3, 2018, from https://en.wikipedia.org/wiki/Bleach_activator.

* cited by examiner

DEVICES FOR REMOVING OXIDIZABLE STAINS AND METHODS FOR THE SAME

TECHNICAL FIELD

The technical field relates generally to removing stains from articles, and more particularly, relates to devices and methods for removing oxidizable stains from clothing, textiles, fabrics, or other like articles.

BACKGROUND

One of the most common problems associated with clothing, textiles, fabrics, or other like articles is that they are susceptible to unwanted tough stains such as from wine, coffee, soda, or other beverages, blueberries, or other foods, grass, blood, and/or the like. Often such stains are not totally removed when the stained articles are washed in a wash liquor that includes detergent via a laundering process or even after being re-washed. To improve removal of such tough stains, prewash treatments, bleach, or activated peroxide compositions can be incorporated into the laundering process to help with stain removal from the article. Unfortunately, this typically requires that the entire article still be subjected to the laundering process to remove the stain.

Further, sometimes spot stain removal absent a laundering process is desired when it is not necessarily convenient to wash the entire article. Other times it is desirable to remove the stain immediately or relatively soon after the stain happens, for example to prevent the stain from setting into the article and/or to quickly restore the article to a clean and presentable condition. However, many commercially available spot stain removers are not necessarily very effective at removing many unwanted tough stains.

Accordingly, it is desirable to provide improved devices and methods for removing unwanted tough stains from clothing, textiles, fabrics, or other like articles which are convenient and do not necessarily require that the entire article be subject to a laundering process. Furthermore, other desirable features and characteristics of the various embodiments described herein will become apparent from the subsequent detailed description and the appended claims, taken in conjunction with the accompanying drawings and this background.

SUMMARY

Devices and methods for removing oxidizable stains, and methods for forming such devices are provided herein. In accordance with an exemplary embodiment, a device for removing an oxidizable stain includes a device body having an opening and an internal space disposed therein that is in fluid communication with the opening. The device body includes a wall that at least partially surrounds the internal space. At least part of the wall is a flexible wall. A frangible wall is disposed in the internal space and separates the internal space into a first chamber and a second chamber. One or more solid components are disposed in the first chamber and include an active oxygen component. Water is disposed in the second chamber. A bleach activator component forms part of the one or more solid components in the first chamber or is included with water in the second chamber. The device is configured such that when a force is applied to strain the flexible wall, the frangible wall breaks in response to allow contact between water and the one or more solid components for activation to form a peracid solution. The one or more solid components disposed in the first chamber and water disposed in the second chamber are not in contact with each other prior to activation.

In accordance with an exemplary embodiment, a method for removing an oxidizable stain is provided. The method includes applying force to a flexible wall of a device body that at least partially surrounds an internal space to strain the flexible wall and break a frangible wall that separates the internal space into a first chamber and a second chamber. The device body is moved to facilitate mixing of one or more solid components in the first chamber with water in the second chamber for activation to form a peracid solution. The one or more solid components include an active oxygen component. A bleach activator component forms part of the one or more solid components in the first chamber or is included with water in the second chamber. The one or more solid components disposed in the first chamber and water disposed in the second chamber are not in contact with each other prior to activation. The peracid solution is fluidly communicated from the internal space through an opening of the device body onto the oxidizable stain.

In accordance with an exemplary embodiment, a method is provided for in-situ generating a peracid solution and for delivering the peracid solution onto an oxidizable stain. The method includes applying force to a flexible wall of a device body that at least partially surrounds an internal space to strain the flexible wall and break a frangible wall that separates the internal space into a first chamber and a second chamber. The device body is moved to facilitate mixing of one or more solid components in the first chamber with water in the second chamber for activation to form a peracid solution. The one or more solid components include an active oxygen component. A bleach activator component forms part of the one or more solid components in the first chamber or is included with water in the second chamber. The one or more solid components disposed in the first chamber and water disposed in the second chamber are not in contact with each other prior to activation. The peracid solution is fluidly communicated from the internal space through an opening of the device body onto the oxidizable stain.

According to a further aspect, a method is provided for pretreating a textile with a peracid solution for removing an oxidizable stain. The method includes applying force to a flexible wall of a device body that at least partially surrounds an internal space to strain the flexible wall and break a frangible wall that separates the internal space into a first chamber and a second chamber. The device body is moved to facilitate mixing of one or more solid components in the first chamber with water in the second chamber for activation to form a peracid solution. The one or more solid components include an active oxygen component. A bleach activator component forms part of the one or more solid components in the first chamber or is included with water in the second chamber. The one or more solid components disposed in the first chamber and water disposed in the second chamber are not in contact with each other prior to activation. The peracid solution is fluidly communicated from the internal space through an opening of the device body onto the oxidizable stain.

BRIEF DESCRIPTION OF THE DRAWINGS

The various embodiments will hereinafter be described in conjunction with the following drawing figures, wherein like numerals denote like elements, and wherein.

DETAILED DESCRIPTION

Figure 1:
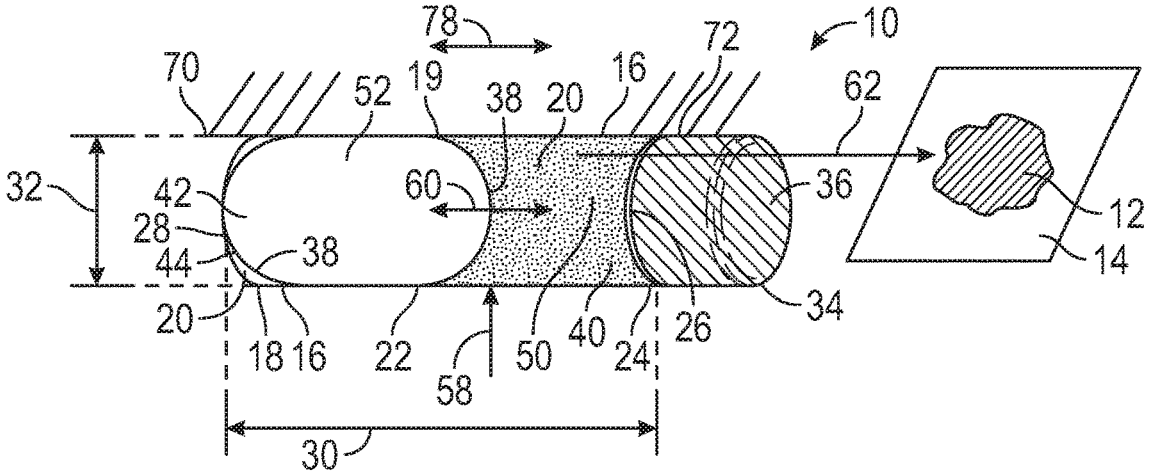
FIG. 1 illustrates a side view of a device for removing an oxidizable stain in accordance with an exemplary embodiment.

The following Detailed Description is merely exemplary in nature and is not intended to limit the various embodiments or the application and uses thereof. Furthermore, there is no intention to be bound by any theory presented in the preceding background or the following detailed description.

Various embodiments contemplated herein relate to devices and methods for removing stains from articles, and methods for forming such devices. The exemplary embodiments taught herein provide a device for treating an unwanted tough stain(s) such as from wine, coffee, soda, or other beverages, blueberries, or other foods, grass, blood, and/or the like that can be oxidized (referred to herein also as "oxidizable stain") with a solution of one or more peroxy acids (referred to herein also as "peracid solution") to remove the stain(s) without any post treatment rinsing or washing required.

The device includes a device body having an opening and an internal space disposed therein that is in fluid communication with the opening. The device body includes a wall that at least partially surrounds the internal space. At least part of the wall is a flexible wall. A frangible wall is disposed in the internal space and separates the internal space into a first chamber and a second chamber. One or more solid components are disposed in the first chamber and include an active oxygen component. Water is disposed in the second chamber, wherein water is herein understood to be in the form of relatively pure water, water which may include one or more other components dissolved and/or contained therein, and/or an aqueous solution. A bleach activator component forms part of the one or more solid components in the first chamber or, alternatively, is included with water in the second chamber, e.g., the bleach activator may be solubilized in water to form an aqueous solution.

A consumer or other device user can use the device to remove an oxidizable stain from a clothing garment or other like article. In an exemplary embodiment, the device user applies a force to the device body, such as by manual flexing or snapping the device body, sufficient to flex or otherwise strain the flexible wall of the device body. The applied force is transferred directly or indirectly from the straining flexible wall of the device body to the frangible wall, which breaks in response to the applied force, thereby allowing fluid communication between the first chamber and the second chamber, e.g., water (e.g., water or aqueous solution including the bleach activator and possibly surfactants, buffers, other beneficial materials, and/or the like) flowing into contact with the one or more solid components. The device user can facilitate mixing of the one or more solid components with water by moving, for example by quick short up-and-down movements or shaking, the device to help drive a chemical reaction of the components and form a peracid solution.

In an exemplary embodiment, the device includes an applicator extending distally from the opening to provide fluid communication from the internal space, through the opening, to a distal end portion of the applicator. The device user contacts the oxidizable stain with the distal end portion of the applicator to fluidly communicate and apply the peracid solution onto the oxidizable stain. In an exemplary embodiment, the peracid solution oxidizes the oxidizable stain, thereby removing the stain from the clothing garment or other like article.

In an exemplary embodiment, because the peracid solution is generated in-situ when needed, advantageously the peracid solution is fresh and therefore, relatively strong and effective at removing the oxidizable stain. Further, advantageously by separating the one or more solid components in the first chamber from water or water with the bleach activator component in the second chamber, the shelf-life of the device is extended or relatively long-lasting. In an additional advantage, the device is generally safer because the peracid solution is not formed until activation when the peracid solution is actually needed to remove an oxidizable stain. In yet another advantage, the peracid solution is color safe on a variety of textiles and fabric, for example cotton, linen, silk, wool, and/or the like. In yet another advantage, the device is convenient and relatively small enough to be carried in a purse, pocket, or put in an office drawer, or the like, and further, the device is disposable after being used to remove an oxidizable stain.

FIG. 1 illustrates a side view of a device 10 for removing an oxidizable stain 12 (e.g., stain from wine, coffee, soda, or other beverages, blueberries, or other foods, grass, blood or the like) from an article 14 (e.g., garment or clothing, textile, fabric article, or other like article) in accordance with an exemplary embodiment. As illustrated, the device 10 includes a device body 16 having a wall 18 that at least partially surrounds an internal space 20. At least part of the wall 18 being a flexible wall 19. For example, the flexible wall 19 may form the entire wall 18 as illustrated, or alternatively, may form a portion of the wall 18.

As will be discussed in further detail below, the flexible wall 19 is relatively flexible so it can be manually flexed, bent, snapped without breaking, or otherwise strained by a device user to activate components contained in the device body 16 to form a solution for removing the oxidizable stain 12. In an exemplary embodiment, the flexible wall 19 is formed of a relatively flexible plastic material such as a polyester thermoplastic material, for example polyethylene terephthalate (PET), or a polyolefin thermoplastic material, for example polyethylene, thermoplastic polyolefin (TPO), polypropylene, or the like. In an exemplary embodiment, the flexible wall 19 has a thickness of from about 0.25 to about 1 mm. The flexible wall 19 may be transparent, translucent, tinted, or otherwise colored, and may contain pigments, dyes, plasticizers, and/or other fillers for plastic materials known to those skilled in the art.

As illustrated, the device body 16 is configured as a cylindrical tube 22 having an open end 24 that defines the opening 26 and a sealed or closed end 28 that is disposed opposite the open end 24. The opening 26 is in fluid communication with the internal space 20.

The device body 16 may be sized to fit in the device users pocket, purse, carrying bag, desk drawer, or the like, as well as to be manipulated by the device user's hands for example as a convenient spot stain remover. In an exemplary embodiment, the tube 22 has a length (indicated by double headed arrow 30) of from about 50 to about 250 mm and a diameter (indicated by double headed arrow 32) of from about 5 to about 20 or 30 mm.

Disposed in and extending distally outward from the opening 26 is an applicator 34. As will be discussed in further detail below, the applicator 34 helps keep the reactive components within the device body 16, prior to activation, while being configured to provide fluid communication from the internal space 20 through the opening 26 to a distal portion 36 of the applicator 34, for example via capillary action, applying an additional force (e.g., squeezing) to the device body 16, and/or the like, once the components have been activated. The applicator 34 may be formed of or include an absorbent material such as cotton or the like, and/or may have micro- or narrow channels, bristles, nibs and/or other features for providing fluid communication from the internal space 20 onto the oxidizable stain 12. In one example, the bristles and nibs of the applicator 34 can advantageously provide mechanical action to facilitate stain removal. Additionally, the applicator 34 may be configured to allow venting of any gases, if any, produced in the internal space 20 during activation of the components, for example through the material or structure (e.g., cotton or the like, and/or micro- or narrow channels, bristles, nibs, and/or one or more vent openings formed therethrough) of the applicator 34.

As illustrated, a frangible wall 38 is disposed in and separates the internal space 20 into chambers 40 and 42. The frangible wall 38 is formed of a relatively brittle material that breaks or otherwise fractures from force transferred directly or indirectly from the flexible wall 19 when the flexible wall 19 flexed or otherwise strained. In an exemplary embodiment, the frangible wall 38 is formed of glass or a relatively brittle plastic material such as polystyrene. In an exemplary embodiment, the frangible wall 38 has a thickness of from about 80 to about 100 μm, for example about 100 μm. In an exemplary embodiment, the chambers 40 and 42, independently, have a volume of from about 2 to about 20 mL, such as from about 5 to about 15 mL, for example from about 8 to about 12 mL.

Figure 2:
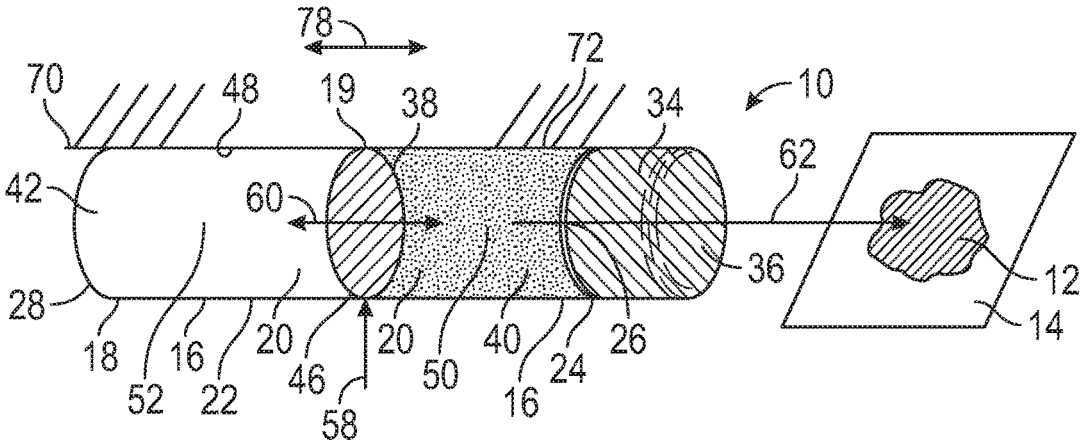
FIG. 2 illustrates a side view of a device for removing an oxidizable stain in accordance with another exemplary embodiment.

In one example and as illustrated FIG. 1, the frangible wall 38 is configured as an ampule 44 that fits snugly within a portion (e.g., bottom or rearward portion) of the internal space 20 surrounding the chamber 42. In another example and as illustrated in FIG. 2, the frangible wall 38 is configured as a disc or plate 46 that is disposed in an intermediate portion of the internal space 20 and extends radially outward to the inner surface 48 of the flexible wall 19 to form a sealed barrier (e.g., sealed via a sealant, ultrasonic or vibrational welding, or the like) between the chambers 40 and 42. In an exemplary embodiment and as illustrated in both FIGS. 1-2, the chamber 40 is disposed in an upper or forward portion of the internal space 20 adjacent to the opening 26, and the chamber 42 is disposed in a bottom or rearward portion of the internal space 20 adjacent to the closed end 28 and the chamber 40 on a side opposite the opening 26.

In an exemplary embodiment, one or more solid components 50 are disposed in the chamber 40 and water 52 is disposed in the chamber 42. In one example, the one or more solid components 50 include a mixture of an active oxygen component (e.g., in powder form) and a bleach activator component (e.g., in powder form). In an alternative example, the one or more solid components 50 include the active oxygen component (e.g., in powder form) and not the bleach activator component which is instead combined, dissolved, or otherwise incorporated into water 52 (e.g., forming an aqueous solution) in the chamber 42. Advantageously, by arranging the one or more solid components 50 in the chamber 40 that is disposed in the upper or forward portion of the internal space 20 adjacent to the applicator 34 and further, by arranging water 52 (e.g., liquid) in the chamber 42 sealed from the chamber 40 and spaced apart from the applicator 34, fluid communication from the internal space 20 via the applicator 34 is prevented at least until the frangible wall 38 is broken.

In an exemplary embodiment, the active oxygen component includes or consists essentially of sodium perborate, sodium percarbonate, sodium perphosphate, sodium persulfate, urea peroxide, perphosphate(s), persulfate(s), persilicate(s), peroxide(s) complexes with carboxylic acid, urea peroxyhydrate(s), or a combination thereof. In an exemplary embodiment, the bleach activator component includes or consists essentially of tetraacetylethylenediamine (TAED), sodium nonanoyloxybenzenesulfonate (NOBS), tetraacetyl glycoluril (TAGU), isononanoyloxybenzene sulfonate (iso-NOBS), sodium benzoyloxybenzene sulfonate (BOBS), diacetyldioxohexahydrotriazine (DADHT), pentaacetyl glucose (PAG), lauroyloxybenzenesulfonate or lauroyloxy benzenesulfonic acid sodium salt (LOBS), decanoyloxybenzoic acid (DOBA), nonoyl amido caprolacid oxybenzene sulfonate (NACA-OBS), benzoyl caprolactam (BCL), cyanopyridine, cyanamide(s), cyanomorpholine, cyanomethyl trialkyl/arylammonium salt(s), a bleach catalyst metal complex(es) such as saltern-Mn(III), Fe-TAML (tetraamido macrocyclic ligand), Mn-DEC (diethyl cyclam), and/or Mn-HMC (hexamethyl cyclam), an aerial bleach system(s) such as Mn-($Me_2EBC$)$Cl_2$ ($Me_2EBC$=4,11-dimethyl-1,4,8,11-tetraazobicyclo[6.6.2] hexadecane) and/or Fe-$MeN_4PY$, and/or a nitrile-base activator. In one example, the bleach activator component is TAED and the active oxygen component is sodium percarbonate. In another example, the bleach activator component is NOBS and the active oxygen component is sodium perborate. In an exemplary embodiment, a mixture of more than one bleach activator component and/or more than one active oxygen component are used to provide an effective peracid cleaning solution for more than one type of stain. In one example, a peracid solution formed by NOBS (peroxynonanoic acid) and LOBS (peroxylauric acid) is used. In particular, LOBS is relatively less water soluble than NOBS and the portion of the peracid cleaning solution formed therefrom works relatively more effectively on removing hydrophobic or more oily stains while the portion of the peracid cleaning solution formed from NOBS works relatively more effectively on removing hydrophilic or more polar stains.

As will be discussed in further detail below, when a force (indicated by single headed arrow 58) is applied to strain the flexible wall 19, the frangible wall 38 breaks in response, allowing fluid communication (indicated by double headed arrow 60) between the chambers 40 and 42 and contact between water and the one or more solid components 50 to form a peracid solution (indicated by single headed arrow 62). In particular, when water contacts the active oxygen component, hydrogen peroxide ($H_2O_2$) is released. The hydrogen peroxide reacts with the bleach activator component ($RCO_2H$) in aqueous solution to form one or more organic peroxy acids ($RCO_3H$) where R is an organic moiety. In one example, the reaction for the formation of hydrogen peroxide from sodium perborate proceeds as according to the reaction illustrated below:

$$NaBO_3(s)+H_2O \rightarrow NaBO_2(aq)+H_2O_2,$$

and the liberated hydrogen peroxide reacts with NOBS ($RCO_2C_6H_4SO_3Na$) according to the reaction illustrated below:

$$RCO_2C_6H_4SO_3Na+H_2O_2 \rightleftharpoons RCO_3H\ HOC_6H_4SO_3Na.$$

In an exemplary embodiment, the reaction of NOBS and hydrogen peroxide occurs at a pH of about 9 to about 10.5 where the peroxide ionizes to form $HOO^-$ and the species for NOBS is deprotonated and proceeds according to the reaction illustrated below:

$$RCO_2C_6H_4SO_3Na+HOO^- \rightleftharpoons RCOOO^-+OC_6H_4SO_3Na.$$

In another example, the liberated hydrogen peroxide reacts with TAED (RCONR'R") according to the reaction illustrated below:

$$RCONR'R''+H_2O_2 \rightleftharpoons RCO_3H+HNR'R''.$$

Figure 3:
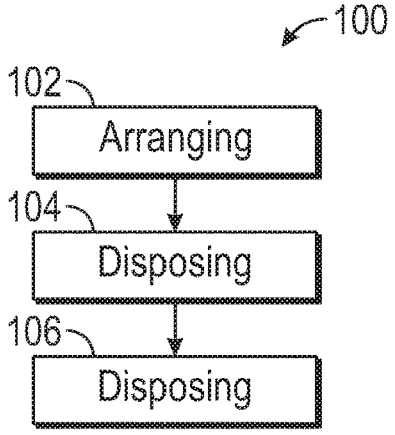
FIG. 3 illustrates a method for forming a device for removing an oxidizable stain in accordance with an exemplary embodiment.

Referring to FIGS. 1-3, a method 100 for forming a device 10 for removing an oxidizable stain 12 is provided. The method 100 includes arranging (STEP 102) a frangible wall 38 in an internal space 20 that is at least partially surrounded by a flexible wall 19 of a device body 16 to separate the internal space 20 into a chamber 40 and a chamber 42. The device body 16 has an opening 26 that is in fluid communication with the internal space 20.

One or more solid components 50 as described in the foregoing paragraphs are disposed (STEP 104) in the chamber 40. Water (e.g., water or an aqueous solution of the bleach activator component) is disposed (STEP 106) in the chamber 42. In an exemplary embodiment, the frangible wall 38 surrounds the chamber 42 to define an ampule 44. The ampule 44 is at least partially filled with water. Arranging the frangible wall 38 in an internal space 20 includes positioning the ampule 44 with water in the internal space 20. The one or more solid components 50 are arranged in the chamber 40 adjacent to the ampule 44.

Figure 4:
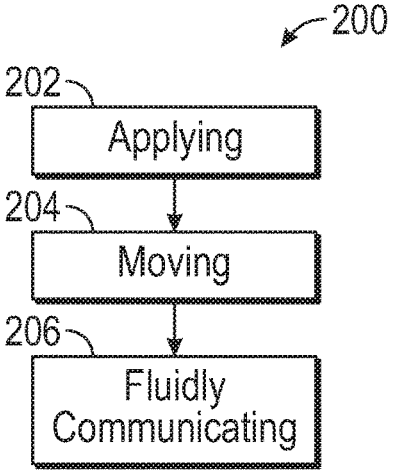
FIG. 4 illustrates a method for removing an oxidizable stain in accordance with an exemplary embodiment.

Referring to FIGS. 1-2 and 4, a method 200 for removing an oxidizable stain 12 is provided. The method 200 includes applying force 58 (STEP 202) to a flexible wall 19 of a device body 16 that at least partially surrounds an internal space 20 to strain the flexible wall 19 and break a frangible wall 38 that separates the internal space 20 into a chamber 40 and a chamber 42. In an exemplary embodiment, a device user holds the device body 16 in their hands at the end portions 70 and 72 and applies the force 58 at an intermediate portion with their thumb(s) to flex, snapped without breaking, or otherwise strain the flexible wall 19, thereby breaking the adjacent frangible wall 38 as the frangible wall 38 is strained by force transferred from the straining flexible wall 19.

The device body 16 is moved (STEP 204), for example by shaking in directions (indicated by double headed arrows 78), to facilitate mixing of one or more solid components 50 in the chamber 40 with water (e.g., water or an aqueous solution) in the chamber 42 to form a peracid solution 62. The peracid solution 62 is fluidly communicated (STEP 206) from the internal space 20 through an opening 26 via an applicator 34 onto the oxidizable stain 12. In one example, the peracid solution 62 is fluidly communicated from the internal space 20 through the opening 26 facilitated by capillary action through the applicator 34 to the distal portion 36 for application onto the oxidizable stain 12. In some embodiments, additional force may be applied to the device body 16, for example by squeezing the flexible wall 19 with the hand of the device user to help soak, wet, or otherwise saturate the applicator 34 with the peracid solution 62 for application onto the oxidizable stain 12. In an exemplary embodiment, the peracid solution 62 oxidizes the oxidizable stain 12 to remove the stain 12 without any post treatment rinsing or washing required. In another embodiment, the peracid solution 62 oxidizes the oxidizable stain 12 to remove the stain 12, leaving behind a residue which may be visible (e.g., white residue) on the article 14, for example depending upon the color of the article 14. The method 200 continues by rinsing the article 14, for example locally rinsing a portion of the article 14 with water e.g., tap water or the like, to remove the residue and allowing the article 14 to dry. In another embodiment, optionally the article 14 may be subjected to a traditional laundering process after the stain 12 has been pre-treated with the peracid solution 62.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A device for removing an oxidizable stain, the device comprising:

a device body having an opening and an internal space disposed therein that is in fluid communication with the opening, the device body comprising a wall that at least partially surrounds the internal space, wherein at least part of the wall is a flexible wall;

a frangible wall disposed in the internal space and separating the internal space into a first chamber and a second chamber;

one or more solid components disposed in the first chamber and comprising an active oxygen component;

water disposed in the second chamber; and a bleach activator component forming part of the one or more solid components in the first chamber or is included with water in the second chamber, wherein the device is configured such that when a force is applied to strain the flexible wall, the frangible wall breaks in response to allow contact between water and the one or more solid components for activation to form a peracid solution, wherein the one or more solid components disposed in the first chamber and water disposed in the second chamber are not in contact with each other prior to activation.

2. The device of claim 1, wherein the one or more solid components disposed in the first chamber comprises both the active oxygen component and the bleach activator component.

3. The device of claim 1, further comprising an applicator disposed adjacent to the opening and extending away from the device body and configured to fluidly communicate the peracid solution from the internal space onto the oxidizable stain.

4. The device of claim 1, wherein the flexible wall comprises a plastic material.

5. The device of claim 4, wherein the plastic material is a thermoplastic material comprising polyester or polyolefin.

6. The device of claim 1, wherein the frangible wall comprises glass or polystyrene.

7. The device of claim 1, wherein the active oxygen component comprises sodium perborate, sodium percarbonate, sodium perphosphate, sodium persulfate, urea peroxide, perphosphate(s), persulfate(s), persilicate(s), peroxide(s) complexes with carboxylic acid, urea peroxyhydrate(s), or a combination thereof.

8. The device of claim 1, wherein the bleach activator component comprises tetraacetylethylenediamine (TAED), sodium nonanoyloxybenzenesulfonate (NOBS), tetraacetyl glycoluril (TAGU), isononanoyloxybenzene sulfonate (iso-NOBS), sodium benzoyloxybenzene sulfonate (BOBS), diacetyldioxohexahydrotriazine (DADHT), pentaacetyl glucose (PAG), lauroyloxybenzenesulfonate or lauroyloxy benzenesulfonic acid sodium salt (LOBS), decanoyloxybenzoic acid (DOBA), nonoyl amido caprolacid oxybenzene sulfonate (NACA-OBS), benzoyl caprolactam (BCL), cyanopyridine, cyanamide(s), cyanomorpholine, cyanomethyl trialkyl/arylammonium salt(s), a bleach catalyst metal complex(es), an aerial bleach system(s), a nitrile-base activator, or a combination thereof.

9. The device of claim 8, wherein the bleach activator component comprises TAED and the active oxygen component comprises sodium percarbonate.

10. The device of claim 8, wherein the bleach activator component comprises NOBS and the active oxygen component comprises sodium perborate.

11. The device of claim 1, wherein the flexible wall surrounds the internal space to define the device body configured as a tube having an open end that defines the opening and a closed end that is disposed opposite the open end.

12. The device of claim 11, wherein the first chamber containing the one or more solid components is disposed adjacent to the open end and the second chamber containing water or water including with the bleach activator component is disposed adjacent to the closed end.

13. The device of claim 11, wherein the tube has a length of from 50 to 250 mm and a diameter of from 5 to 30 mm.

14. The device of claim 1, wherein the first chamber has a first volume of from 2 to 20 mL, and wherein the second chamber has a second volume of from 2 to 20 mL.

15. The device of claim 1, wherein the frangible wall defines an ampule that includes the first chamber or the second chamber and that is disposed in the internal space at least partially surrounded by the flexible wall.

16. The device of claim 15, wherein the ampule includes the second chamber surrounded by the frangible wall.

17. The device of claim 1, wherein the flexible wall has an inner surface facing towards and surrounding the internal space, and wherein the frangible wall extends radially outward in the internal space to the inner surface of the flexible wall.

18. A method for removing an oxidizable stain, the method comprising the steps of:

applying force to a flexible wall of a device body that at least partially surrounds an internal space to strain the flexible wall and break a frangible wall that separates the internal space into a first chamber and a second chamber;

moving the device body to facilitate mixing of one or more solid components in the first chamber with water in the second chamber for activation to form a peracid solution, wherein the one or more solid components comprise an active oxygen component, wherein a bleach activator component forms part of the one or more solid components in the first chamber or is included with water in the second chamber, and wherein the one or more solid components disposed in the first chamber and water disposed in the second chamber are not in contact with each other prior to activation; and fluidly communicating the peracid solution from the internal space through an opening of the device body onto the oxidizable stain.

19. The method of claim 18, wherein fluidly communicating comprises applying additional force to the flexible wall after activation to facilitate advancing the peracid solution from the internal space through the opening of the device body onto the oxidizable stain.

20. The method of claim 18, wherein the oxidizable stain is disposed on an article, and wherein the method further comprises the steps of:

allowing the peracid solution to oxidize the oxidizable stain to remove the oxidizable stain leaving a residue on the article:

rinsing the residue from the article leaving a wetted, clean portion of the article; and allowing the wetted, clean portion of the article to dry.

* * * * *